US011871808B2

(12) United States Patent
Hanudel et al.

(10) Patent No.: US 11,871,808 B2
(45) Date of Patent: Jan. 16, 2024

(54) NAPE PAD FOR A HELMET

(71) Applicant: Gentex Corporation, Simpson, PA (US)

(72) Inventors: Matthew Hanudel, Dedham, MA (US); Duco Noordzij, Roslindale, MA (US)

(73) Assignee: GENTEX CORPORATION, Simpson, PA (US)

( * ) Notice: Subject to any disclaimer, the term of this patent is extended or adjusted under 35 U.S.C. 154(b) by 193 days.

(21) Appl. No.: 17/413,389

(22) PCT Filed: Dec. 31, 2019

(86) PCT No.: PCT/US2019/069107
§ 371 (c)(1),
(2) Date: Jun. 11, 2021

(87) PCT Pub. No.: WO2020/142516
PCT Pub. Date: Jul. 9, 2020

(65) Prior Publication Data

US 2022/0031004 A1 Feb. 3, 2022

Related U.S. Application Data

(60) Provisional application No. 62/788,356, filed on Jan. 4, 2019.

(51) Int. Cl.
*A42B 3/12* (2006.01)
*A42B 3/08* (2006.01)
(Continued)

(52) U.S. Cl.
CPC ..... *A42B 3/127* (2013.01); *A42B 3/085* (2013.01); *A42B 3/105* (2013.01); *A42B 3/142* (2013.01); *A42B 3/145* (2013.01)

(58) Field of Classification Search
CPC ..... A42B 3/085; A42B 3/142; A42B 3/145; A42B 3/127
See application file for complete search history.

(56) References Cited

U.S. PATENT DOCUMENTS 3,103,014 A * 9/1963 Morgan ..... A42B 3/10 2/415
3,591,863 A * 7/1971 Rickard ..... A42B 3/0473 2/415

(Continued)

OTHER PUBLICATIONS

International Search Report and Written Opinion dated Mar. 25, 2020, for International Patent Application No. PCT/US2019/069107, 9 pages.

(Continued)

*Primary Examiner* — Katherine M Moran
(74) *Attorney, Agent, or Firm* — Morgan, Lewis & Bockius LLP

(57) ABSTRACT

A nape pad for use with a helmet, the nape pad comprising: a base comprised of a rigid material and having an outer surface and an inner surface, a left side and a right side, and a top edge and a bottom edge, the outer surface being generally convex from the left side to the right side and having an upper portion proximate the top edge and a lower portion proximate the bottom edge, the upper portion being generally smooth and configured to extend into and slide along an inner surface of the helmet, the inner surface of the base being generally concave from the left side to the right side; a fastener coupled to the lower portion of the base and configured to releasably couple to a retention system of the helmet; and at least one compressible comfort pad coupled to the inner surface of the base.

16 Claims, 17 Drawing Sheets

(51) Int. Cl.
*A42B 3/10* (2006.01)
*A42B 3/14* (2006.01)

(56) References Cited

U.S. PATENT DOCUMENTS 3,843,970 A * 10/1974 Marietta ..... A42B 3/127 2/415
3,873,997 A * 4/1975 Gooding ..... A42B 3/0473 2/416
3,943,572 A 3/1976 Aileo
3,994,020 A 11/1976 Villari
5,898,950 A * 5/1999 Spyrou ..... A42B 3/085 2/421
7,797,764 B2 * 9/2010 Norris ..... A42B 3/105 2/468
11,116,273 B2 * 9/2021 Rudd ..... A42B 3/12
2004/0078877 A1 4/2004 Harty
2006/0096011 A1 * 5/2006 Dennis ..... A42B 3/145 2/421
2010/0031409 A1 * 2/2010 Norris ..... A42B 3/105 2/2.5
2010/0306904 A1 * 12/2010 Neid ..... A42B 1/08 2/414
2017/0295882 A1 * 10/2017 Walsh ..... A42B 3/105
2018/0049505 A1 * 2/2018 Hovan ..... A42B 3/105
2018/0092424 A1 * 4/2018 Hall ..... A42B 3/142
2020/0077721 A1 * 3/2020 Peterson ..... A42B 3/105
2021/0251328 A1 * 8/2021 Roberts ..... A42B 3/085

OTHER PUBLICATIONS

Ops-Core Universal Nape Pad (OPS-CORE1) 2018. Retrieved from the Internet on Feb. 28, 2020. URL: <https://shop.gentexcorp.com/content/Ops-Core_Universal_Nape_Pad_User_Manual.pdf>.
Ops-Core SF Helmet Systems Operator's Manual (OPS-CORE2) 2017. Retrieved from the Internet on Feb. 28, 2020. URL: <https://www.rtstactical.com/pub/media/solwin/productattachment/attachment/file/o/p/ops-core-a14570_-_installation_operation_instructions.pdf>.

* cited by examiner

NAPE PAD FOR A HELMET

CROSS REFERENCE TO RELATED APPLICATIONS

This application is a U.S National Phase of International Application No. PCT/US2019/069107 filed on Dec. 31, 2019, which claims the benefit of U.S. Provisional Patent Application No. 62/788,356 filed Jan. 4, 2019 entitled "Protection Attachment for a Helmet", which is incorporated by reference herein in its entirety.

FIELD OF THE INVENTION

The present invention generally relates to a retention system for a helmet and, more particularly, to a nape pad for attaching to the helmet retention system.

BRIEF SUMMARY OF THE INVENTION

As disclosed herein, the nape pad may help to provide improved stability and comfort of the retention system by contacting a larger area of the user's nape. While contacting a larger area, the nape pad is configured to still allow for the user to move his or her head with limited obstruction.

In one embodiment, there is a nape pad for use with a helmet, the nape pad comprising: a base, a fastener, and at least one compressible comfort pad. The base may be comprised of a rigid material, have an outer surface, an inner surface, a left side, a right side, a top edge, and a bottom edge. The outer surface may be generally convex from the left side to the right side. The outer surface may have an upper portion proximate the top edge, and a lower portion proximate the bottom edge. The upper portion may be generally smooth and configured to extend into and slide along an inner surface of the helmet. The inner surface of the base may be generally concave from the left side to the right side. The fastener may be coupled to the lower portion of the base and configured to releasably couple to a retention system of the helmet. The at least one compressible comfort pad may be coupled to the inner surface of the base.

In one embodiment, the top edge is defined in one plane by the radius of an arcuate portion of a circle. The arcuate portion may be configured to generally contour to the nape of a user's neck. In one embodiment, the bottom edge has generally the same radius as the top edge. In one embodiment, the base may have a width, which is defined by the lateral distance between the left and right sides and a height that is defined by the longitudinal distance between the top and bottom edge. In one embodiment, the height of the base may be generally equal to the width. In one embodiment, the height of the base may be greater than or equal to the width. In one embodiment, the base may be comprised of one or more of a ceramic material, an aromatic fiber, a metal, a polycarbonate, or a reinforced polymer. In one embodiment, the bottom edge may include a flared portion extending along the bottom edge. The flared portion may be curved away from the inner surface of the base. The flared portion may extend from the bottom edge of the base to at least part of the lower portion of the base.

In one embodiment, the fastener may include indicia markings corresponding to a plurality of attachment positions along the fastener. In one embodiment, the fastener is a first fastener and the base includes a second fastener coupled to the inner surface of the base. The at least one compressible comfort pad may releasably couple to the second fastener. In one embodiment, the fastener may include a plurality of hooks to form half of a hook and loop fastener. In one embodiment, there is a helmet retention system comprising: the nape pad as previously described, a helmet, and a retention system. The helmet may have a front area, a rear area and a bottom periphery. The retention system may be coupled to the helmet and the at least one fastener of the nape pad. The upper portion of the nape pad may slidably couple to the inner surface of the helmet.

In one embodiment, there is a stability system comprising: a helmet, a retention system, a base, a first fastener coupled to the base, a second fastener coupled to the base, and at least one compressible comfort pad. The helmet may have a front portion, a rear portion, and a bottom periphery. The retention system may be comprised of at least one front strap, at least one rear strap, and at least one cross strap. The at least one front strap may be coupled to an inside surface of the helmet and extend downwardly from the front portion of the helmet. The at least one rear strap may be coupled to the inside surface of the helmet and extend downwardly from the rear portion of the helmet. The at least one cross strap may couple the at least one rear strap and at least one front strap and be generally transverse to one or more of the at least one front strap and the at least one rear strap. The base may be comprised of a rigid material and have an outer surface, an inner surface, a left side, a right side, a top edge, and a bottom edge. The outer surface may be generally convex from the left side to the right side. The outer surface may have an upper portion which is generally smooth and slidably coupled the inside surface of the helmet. The inner surface of the base may be generally concave from the left side to the right side. The first fastener may be coupled to the lower portion of the base and may be releasably coupled to the retention system. The first fastener may include a plurality of hooks to form half of a hook and loop fastener. The at least one compressible comfort pad may be coupled to the inner surface of the base. The second fastener may be coupled to the lower portion of the base opposite the first fastener. The second fastener may include a plurality of hooks to form half of a hook and loop fastener. The at least one compressible pad may be releasably coupled to the second fastener.

The base may have a width defined by the lateral distance between the left and right sides and a height defined by the longitudinal distance between the top and bottom edge, the height being greater than or equal to the width. In one embodiment, the bottom edge may include a flared portion extending along the bottom edge. In one embodiment, the flared portion may be curved away from the inner surface of the base. In one embodiment, the flared portion may extend from the bottom edge to at least part of the lower portion of the base.

BRIEF DESCRIPTION OF THE SEVERAL VIEWS OF THE DRAWINGS

The foregoing summary, as well as the following detailed description of embodiments of the nape pad for a helmet, will be better understood when read in conjunction with the appended drawings of an exemplary embodiment. It should be understood, however, that the invention is not limited to the precise arrangements and instrumentalities shown.

In the drawings.

DETAILED DESCRIPTION OF THE EXEMPLARY EMBODIMENTS OF THE INVENTION

Figure 1:
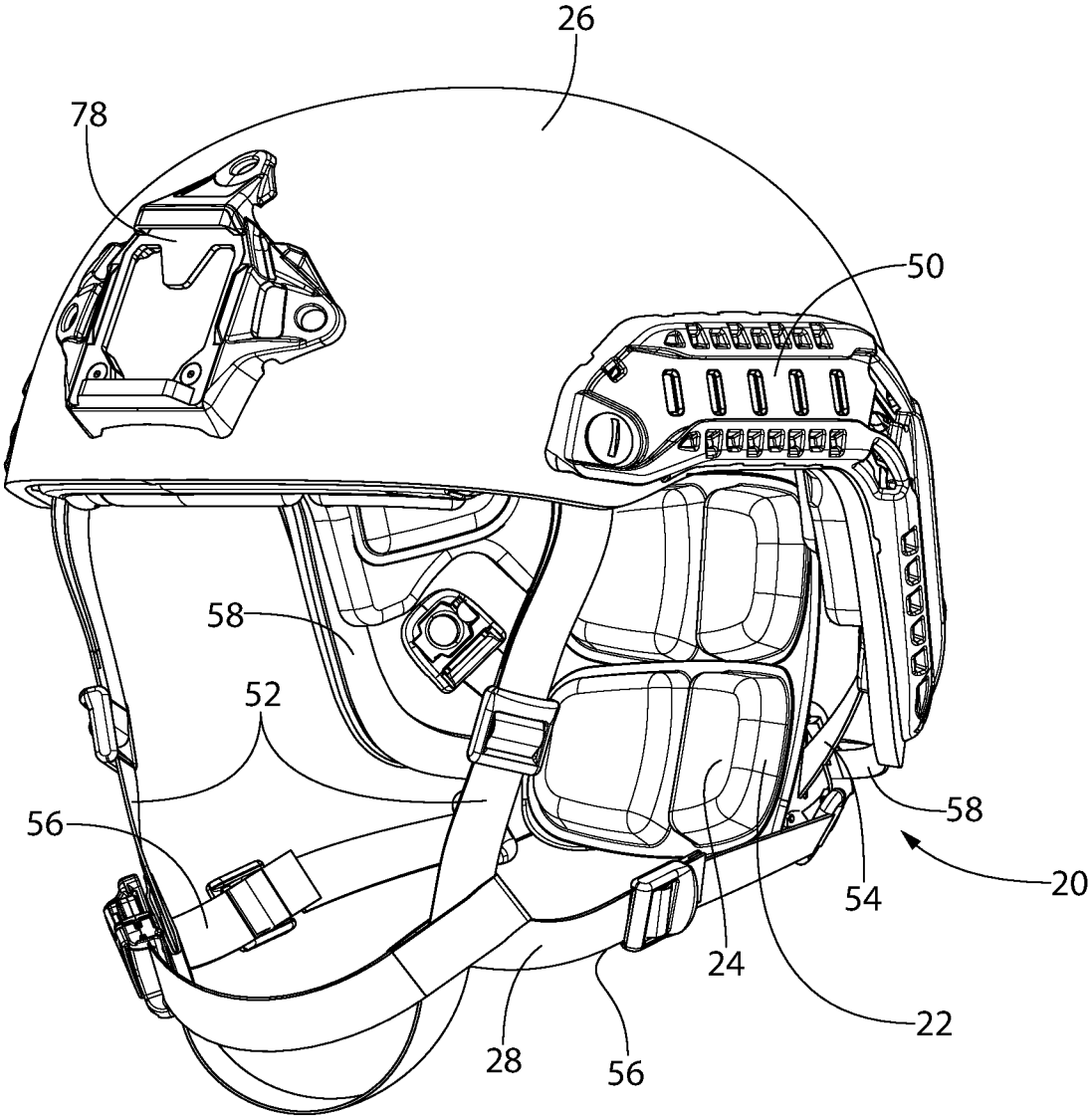
FIG. 1 is a front perspective view of a helmet system having a nape pad in accordance with an exemplary embodiment of the present invention coupled to a retention system of a helmet.

Referring to the drawings in detail, wherein like reference numerals indicate like elements throughout, there is shown in FIGS. 1-18 a nape pad, generally designated 20, in accordance with an exemplary embodiment of the present invention. The nape pad 20 may also be referred to as a stability attachment, comfort attachment or protection attachment.

While retention systems employing a plurality of straps are commonly used to fasten a helmet to a user's head, the straps which extend across the nape, the base of the neck extending from the back of the user's head, are often rough and lack any padding causing an uncomfortable fit for the user. Additionally, the straps which extends across the nape often have a relatively small surface area, causing forces from the retention system, due to fastening the helmet to the user's head, to be focused in a small localized area where the straps contact the nape of the neck, leading to additional discomfort experienced by the user. While helmets also effectively protect a user's head, the nape is often left substantially unprotected and vulnerable to injury. Nape comfort and protection can be critical in numerous helmet deployments; for example, the need for nape comfort and protection is particularly important in military, firefighters, law enforcement and other emergency response personnel and industrial personnel operating in high performance environments. Nape pad 20 may be configured to increase the comfortability of a helmet 26 and retention system 28 felt by a user by covering a larger portion of the neck than the retention system 28 and by separating the nape from the retention system 28. Nape pad 20 may include a base 22 configured to separate the nape of a user's neck from a retention system 28 and spread the forces from the retention system 28 over a larger surface area to increase comfortability felt by a user. Nape pad 20 may include at least one compressible pad 24 coupled to the base 22 and configured to contact the nape and neck of a user to provide additional support and increase comfortability. Nape pad 20 may be configured to protect a nape of a user's neck by resisting impacts (e.g., ballistic impacts and/or blunt force impacts) or resisting piercing (e.g., from shrapnel). Nape pad 20 may include a base 22 configured to resist projectile impacts and at least one compressible pad 24 configured to spread the force from a blunt force impact over a larger surface area to reduce the impact felt by a user. Nape pad 20 may be coupled to a helmet 26 to provide head and nape protection in one system. In some embodiments, nape pad 20 is coupled to a retention system 28 for the helmet 26. A fastener 30 (e.g., a hook and loop fastener) may couple nape pad 20 to the helmet retention system 28 such that the position of nape pad 20 may be adjusted to accommodate the anatomy and/or preference of the user.

The nape pad 20 may be configured to resist at least one of shrapnel, ballistic impacts, or blunt force impacts. The nape pad may include an impact resistant base 22 and at least one compressible pad 24. The size of nape pad 20 is larger than existing nape pads and therefore increases protection by covering a larger area while increasing comfort by dissipating the compression force on the user and by slidably engaging the inner surface of the helmet as discussed in further detail below.

Referring to FIGS. 2-11 nape pad 20 may include base 22, at least one compressible pad 24 and fastener 30. Nape pad 20 may be configured to fit within an interior of a helmet and around a portion of a user's neck and/or head. Nape pad 20 may be able to move relative helmet 26 (FIG. 1) in at least one direction. For example, nape pad 20 may be able to move up and down relative helmet 26, pivot relative to helmet 26, or a combination of both. Compressible pad 24 and base fastener 30 may be directly coupled to nape pad 20. In some embodiments, compressible pad 24 is detachably coupled to base 22 in a position opposite base fastener 30. Base 22 may have an inner surface with a generally or slightly concave shape to accommodate a comfortable fit between nape pad 20 and a user's neck or head. Base 22 may have an exterior surface with a generally or slightly convex shape to nest within helmet 26.

Figure 4:
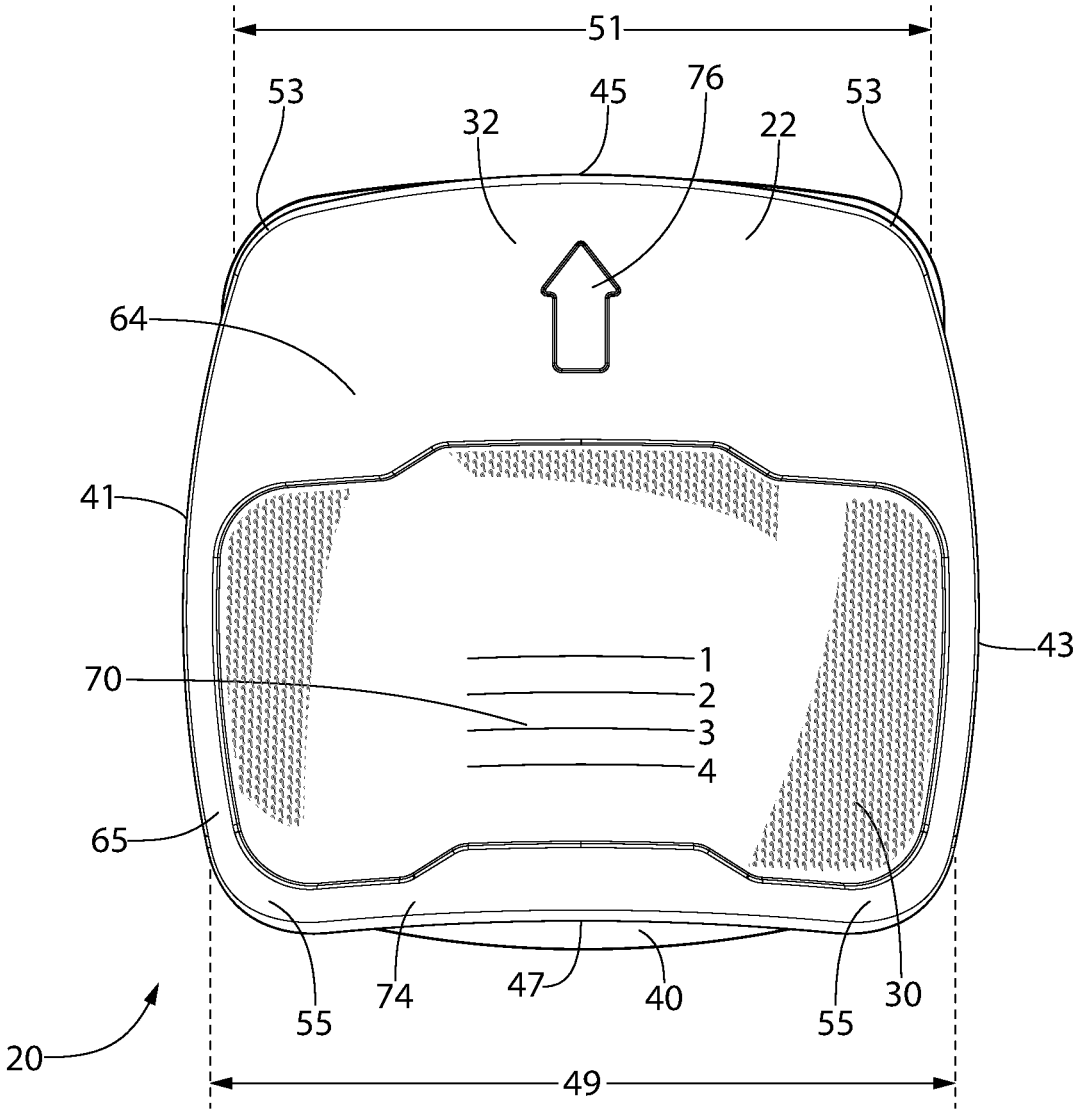
FIG. 4 is a rear elevational view of the nape pad of FIG. 1.
Figure 5:
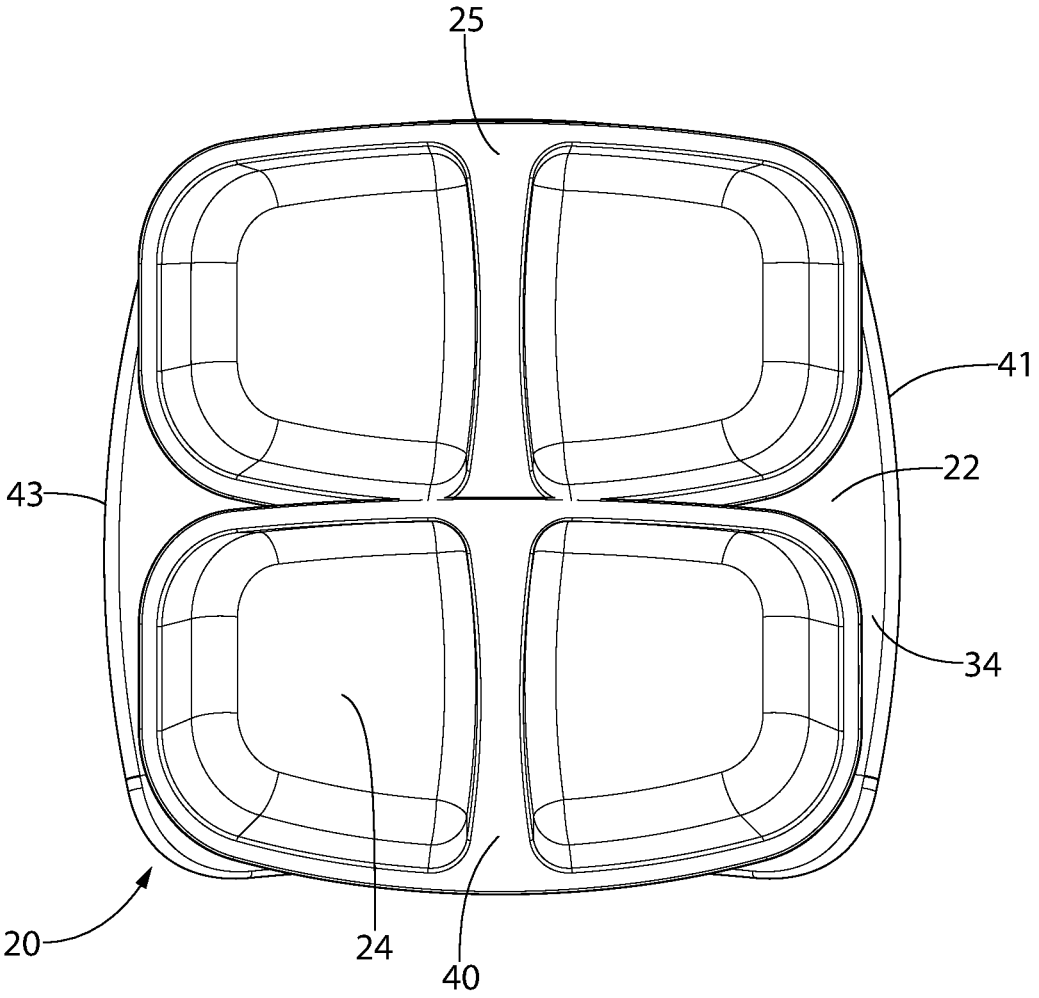
FIG. 5 is a front elevational view of the nape pad of FIG. 1.

Referring to FIG. 4, base 22 may have a generally rectangular shape when viewed from the rear. Base 22 may include left side 41 (e.g., a left lateral edge), right side 43 (e.g., a right lateral edge), top edge 45, and bottom edge 47. Top edge 45 may be defined in one plane by an arcuate portion of circle 38 (FIG. 8) having radius 39 which may be between about 60 mm and about 80 mm. The arcuate portion 38 may be configured to generally follow the contour of the nape of a user's neck. The radius 39 of the arcuate portion 38 may be generally the same as the radius of a rear inner surface portion of helmet 26. Top edge 45 may have a continuous radius 39 between left side 41 and right side 43. Top edge 45 may have varying radii between left side 41 and right side 43. Bottom edge 47 may be defined in one plane by an arcuate portion of a circle. In some embodiments, bottom edge 47 has a different radius than top edge 45. In other embodiments, bottom edge 47 has generally the same radius as top edge 45.

Referring to FIGS. 2-5, base 22 may include inner surface 34 and outer surface 32 opposite inner surface 34. Inner surface 34 may be generally concave between the left side 41 and the right side 43. Outer surface 32 may be generally convex between left side 41 and right side 43. In some embodiments, the curvature of inner surface 34 and outer surface 32 is generally the same. In other embodiments, the curvature of the inner surface 34 and the outer surface 32 are different such that some portions of base 22 are thicker than other portions. Inner surface 34 may be curved to generally match the inner contour of helmet 26. Outer surface 32 may be curved to generally match the contour of a user's nape. In some embodiments, at least one of inner surface 34 and outer surface 32 is generally straight between top edge 45 and bottom edge 47 such that at least a portion of base 22 comprises a cylindrical shape. In other embodiments, at least one of inner surface 34 and outer surface 32 includes a curvature extending at least partially from top edge 45 to bottom edge 47.

Referring to FIG. 4 At least one of corners 53 between top edge 45 and left side 41 and between top edge 45 and right side 43 may be rounded. At least one of corners 55 between bottom edge 47 and left side 41 and between bottom edge 47 and right side 43 may be rounded. In some embodiments, corners 53 and 55 may be rounded such that they have a generally equal radius of curvature. Corner 53 may have a radius of about 5 mm, about 10 mm, about 15 mm, or about 20 mm. Corner 55 may have a radius of about 5 mm, about 10 mm, about 15 mm, or about 20 mm. In some embodiments, the radius of corner 53 is different from the radius of corner 55. In some embodiments, corners 53 and 55 may have an increasing radius of curvature from sides 41, 43 to edges 45, 47 respectively. In some embodiments, corners 53 and 55 may have a decreasing radius of curvature from sides 41, 43 to edges 45, 47 respectively. In other embodiments, corners 53 and 55 may have a 90 degree angle. In some embodiments, corners 53 and 55 may extend between sides 41, 43 and edges 45, 47 at a generally constant angle relative sides 41 and 43 respectively.

Figure 2:
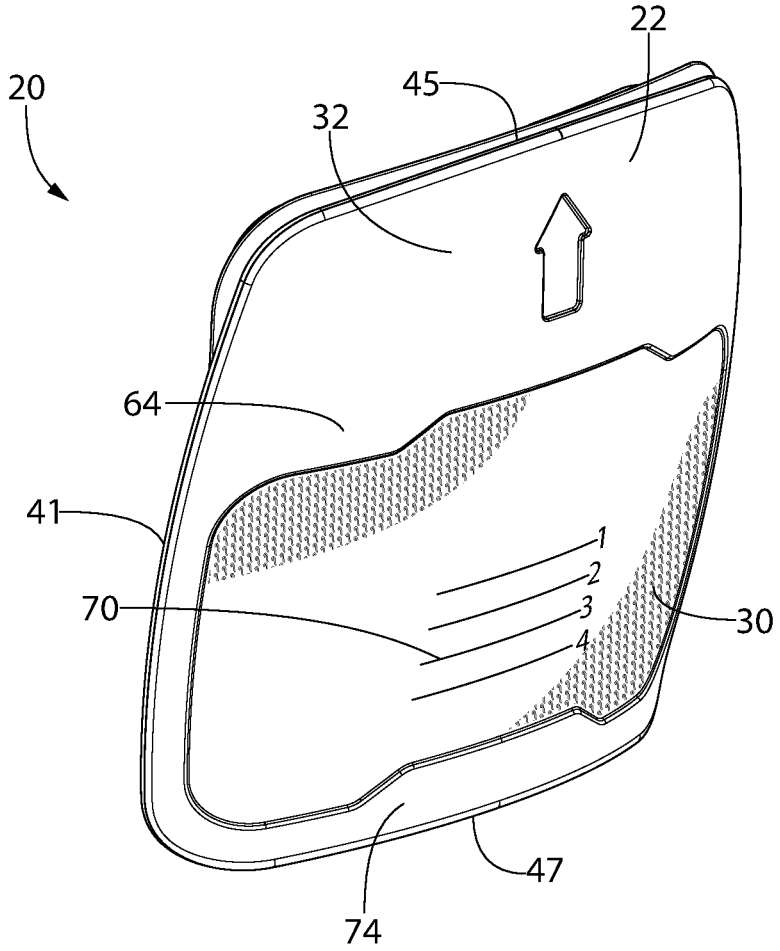
FIG. 2 is a rear perspective view of the nape pad of FIG. 1.
Figure 3:
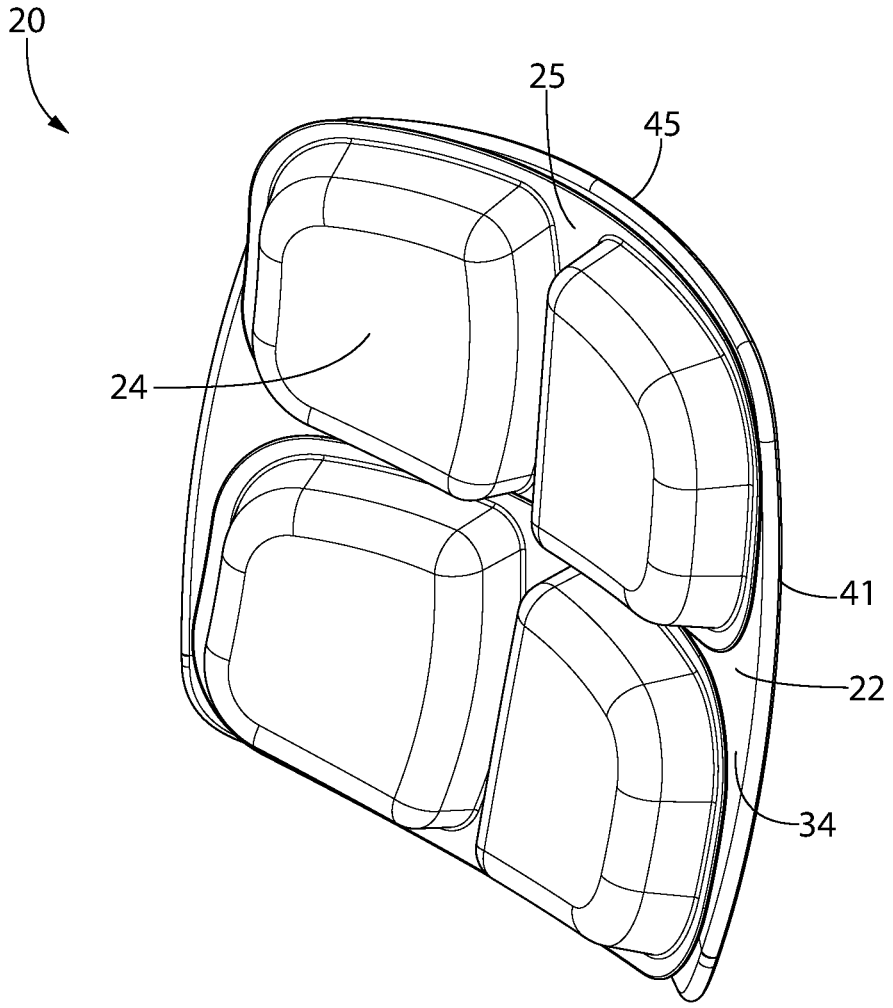
FIG. 3 is a front perspective view of the nape pad of FIG. 1.

Referring to FIGS. 2 and 4, base 22 may also include upper portion 64 proximate top edge 45 and lower portion 65 adjacent upper portion 64 and proximate bottom edge 47. Lower portion 65 may include a recessed area configured to receive base fastener 30. The recessed area of lower portion 65 may have an irregular geometric shape. The recessed area of lower portion 65 may have a shape that is symmetrical along at least one axis. In some embodiments, the recessed area of lower portion 65 may have a regular geometric shape. The recessed area of lower portion 65 may be generally convex such that the curvature is generally the same as the curvature of outer surface 32. In one embodiment, base fastener 30 may be coupled to outer surface 32 of base 22 within an area of lower portion 65. Base fastener 30 may have a thickness such that it is equal to or less than the depth of the recessed area of lower portion 65. In some embodiments base fastener 30 may have a thickness that it is greater than the depth of the recessed area of lower portion 65. In some embodiments base fastener 30 may be flexible enough to contour to the generally convex shape of outer surface 32. In some embodiments, base fastener 30 may be rigid and have a predetermined curvature that is configured to generally match the curvature of outer surface 32. In one embodiment, lower portion 65 may not include a recessed area and base fastener 30 may be coupled directly to lower portion 65 of outer surface 32. In some embodiments, the base fastener 30 is a hook and loop fastener. In one embodiment, the base fastener 30 includes a plurality of loops for releasably coupling to a corresponding plurality of hooks on the retention system (e.g., see fastener 78 in FIG. 18). In other embodiments, the base fastener 30 is a magnet, snap fit, or adhesive. In some embodiments base fastener 30 may comprise more than one of the above fasteners.

Upper portion 64 may be generally smooth and configured to extend into and slide along an inner surface of helmet 26, as discussed below. In one embodiment both inner surface 34 and outer surface 32 of upper portion 64 are generally smooth. In one embodiment, only one of inner surface 34 and outer surface 32 of upper portion 64 are generally smooth. In one embodiment upper portion 64 may be configured extend into and slide within layers of an inner surface of helmet 26. Upper portion 64 may include at least one extra feature configured to guide a user when coupling nape pad 20 relative helmet 26. The extra feature may be a directional feature 76 such as an arrow or other directional marker. In one embodiment, smooth upper portion 64 may be configured to slide between an inner surface of helmet 26 and a portion of retention system 28. Upper portion 64 may include external features, which are configured to guide base 22 as it slides along an inner surface of helmet 26.

Figure 6:
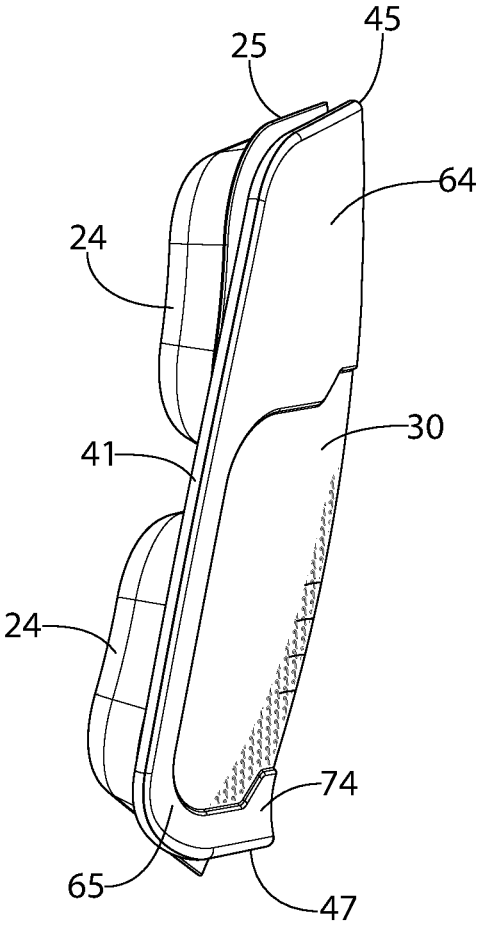
FIG. 6 is a left side elevational view of the nape pad of FIG. 1.
Figure 7:
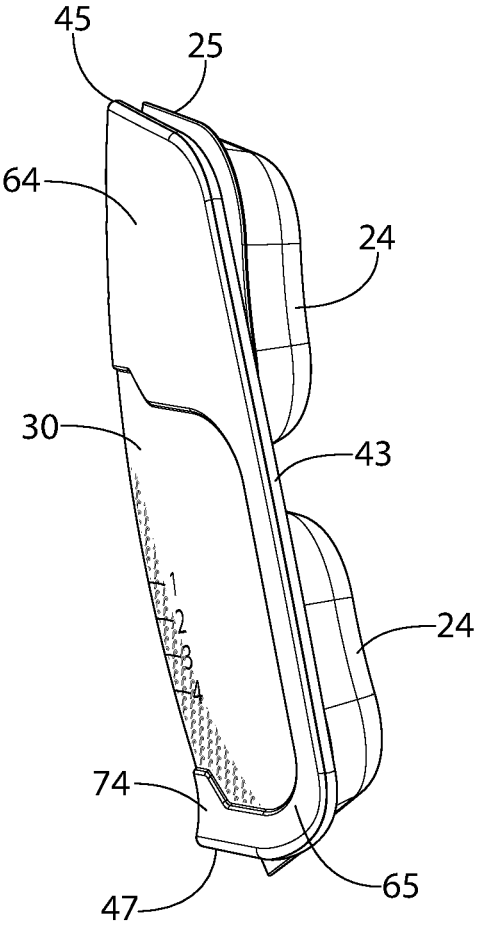
FIG. 7 is a right side elevational view of the nape pad of FIG. 1.
Figure 8:
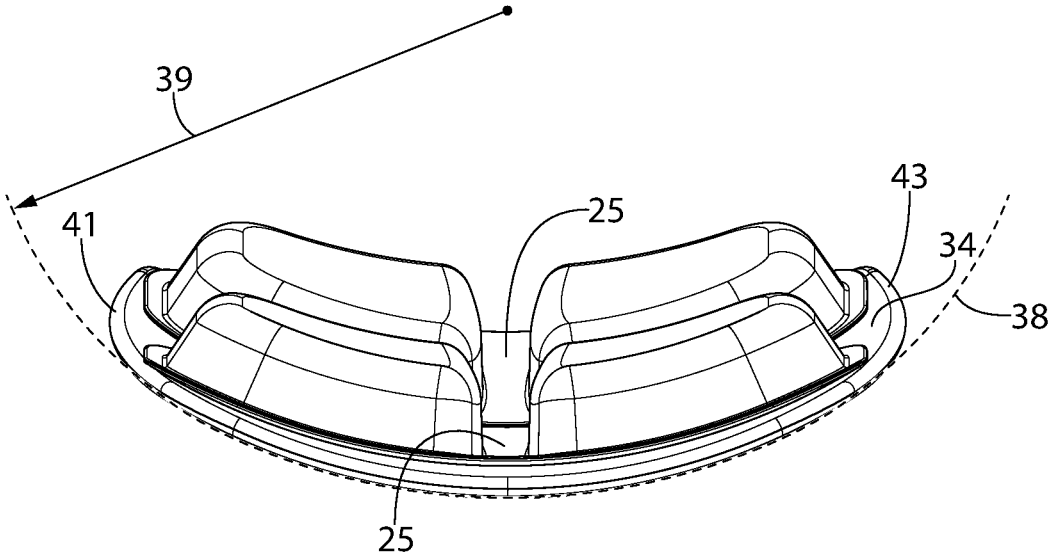
FIG. 8 is a top plan view of the nape pad of FIG. 1.
Figure 9:
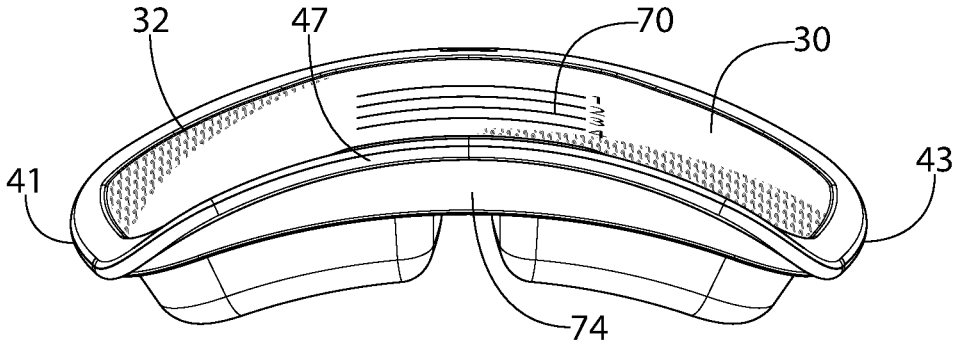
FIG. 9 is a bottom plan view of the nape pad of FIG. 1.
Figure 10:
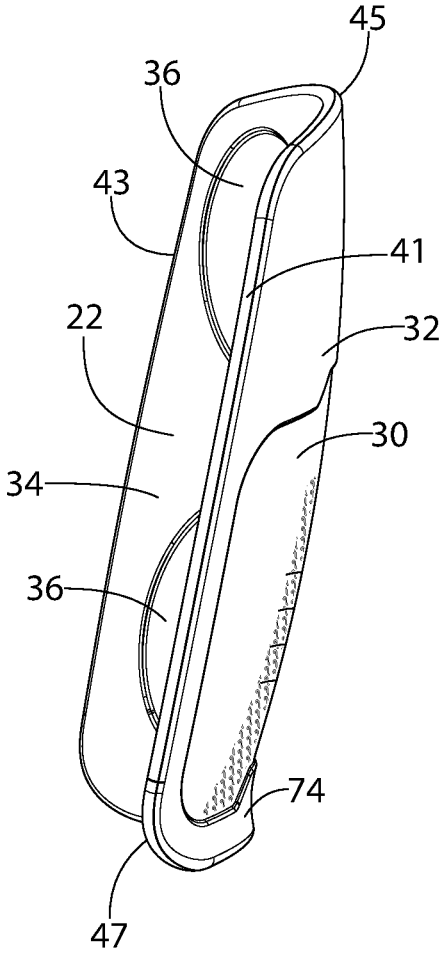
FIG. 10 is a side perspective view of the base of the nape pad of FIG. 1.

Referring to FIGS. 6, 7, and 9, base 22 may include flared portion 74, flared portion 74 may be flared (e.g., curved) outwardly near bottom edge 47 so that bottom edge 47 does not press into the user's nape or upper back when the user tilts their head up. Flared portion 74 may be curved laterally outward between left side 41 and right side 43. Flared portion 74 may be between base fastener 30 and bottom edge 47. The laterally outward curvature of flared portion 74 may extend on at least one of inner surface 34 and outer surface 32. The curvatures of flared portion 74 may be defined in one plane by an arcuate portion of a circle. The curvatures of flared portion 74 may be different from the curvatures of at least one of the corresponding inner surface 34 and outer surface 32. For example, outer surface 32 may be convex partially from top edge 45 to bottom edge 47 and the curvature flared portion 74 extending on outer surface 32 may be concave from where the convex curve of outer surface 32 ends to bottom edge 47. In some embodiments, the shape of the curvatures of flared portion 74 may be generally identical on both the inner surface 34 and outer surface 32 such that both curvatures are directed away from at least a portion of inner surface 32. In some embodiments, the shape of the curvatures of flared portion 74 on both inner surface 34 and outer surface 32 may be different such that both curvatures are directed away from at least a portion of inner surface 32. The laterally outward curve of flared portion 74 may have a radius of about 100 mm to about 200 mm, about 125 mm, about 150 mm, or about 175 mm.

In some embodiments, instead of at least one curvature, flared portion 74 may include at least one flat segment extending towards to bottom edge 47 and away from at least a portion of inner surface 34 at a generally constant angle. In some embodiments, flared portion 74 may additionally include at least one flat segment extending towards to bottom edge 47 and away from at least a portion of inner surface 34 at a generally constant angle. In some embodiments, the curvature of flared portion 74 on outer surface 32 extend from bottom edge 47 and terminate before reaching base fastener 30. In some embodiments, the curvature of flared portion 74 on outer surface 32 extend from bottom edge 47 into at least a portion of base fastener 30. In some embodiments, at least of the curvatures of flared portion 74 has a generally constant radius of curvature. In some embodiments, at least of the curvatures of flared portion 74 has a radius of curvature, which increases from base fastener 30 to bottom edge 47. In some embodiments, at least of the curvatures of flared portion 74 has a radius of curvature, which increases from bottom edge 47 to base fastener 30.

Referring to FIG. 4, in some embodiments, linear distance 49 between left side 41 and right side 43 as measured in one plane at top edge 45 is longer than the linear distance 51 as measured in the same plane at top edge 45. In other embodiments, linear distance 49 is generally the same as linear distance 51. In some embodiments, the radius of top edge 45 is different from the radius of bottom edge 47 such that linear distance 49 is different from linear distance 51 even though the length of top edge 45 and bottom edge 47 are generally the same (FIG. 7). Base 22 may have a width of about 90 mm, about 95 mm, about 100 mm, about 105 mm, about 110 mm, about 115 mm, or about 120 mm. Base 22 may have a height of about 85 mm, about 90 mm, about 95 mm, about 100 mm, about 105 mm, about 110 mm, about 115 mm, or about 120 mm. Base 22 may have a thickness of about 1 mm, about 1.5 mm, about 2 mm, about 2.5 mm, about 3 mm, about 3.5 mm, or about 4 mm.

Base 22 may be comprised of a material configured to provide ballistic protection. In some embodiments, base 22 is configured to provide ballistic protection generally equal to the ballistic protection of the helmet. In some embodiments, base 22 is comprised of one or more or ceramic, aromatic fiber, metal, polycarbonate, or reinforced polymer (e.g., glass reinforced polymer). Base 22 may resist ballistic impacts from a projectile having a size of 8 millimeters or less (e.g., from a 7.62 mm bullet). Base 22 may resist at least one of a 2 grain right circular cylinder (RCC) traveling 3,100 feet per second (f/s); a 4 grain RCC traveling 2,550 f/s; a 16 grain RCC traveling 2,250 f/s; a 17 grain RCC traveling 2,200 f/s; a 64 Grain RCC; or a 9 millimeter full metal jacket round nose projectile traveling at 1,200 f/s. In some embodiments, base 22 is rigid. In other embodiments, base 22 is flexible.

Figure 11:
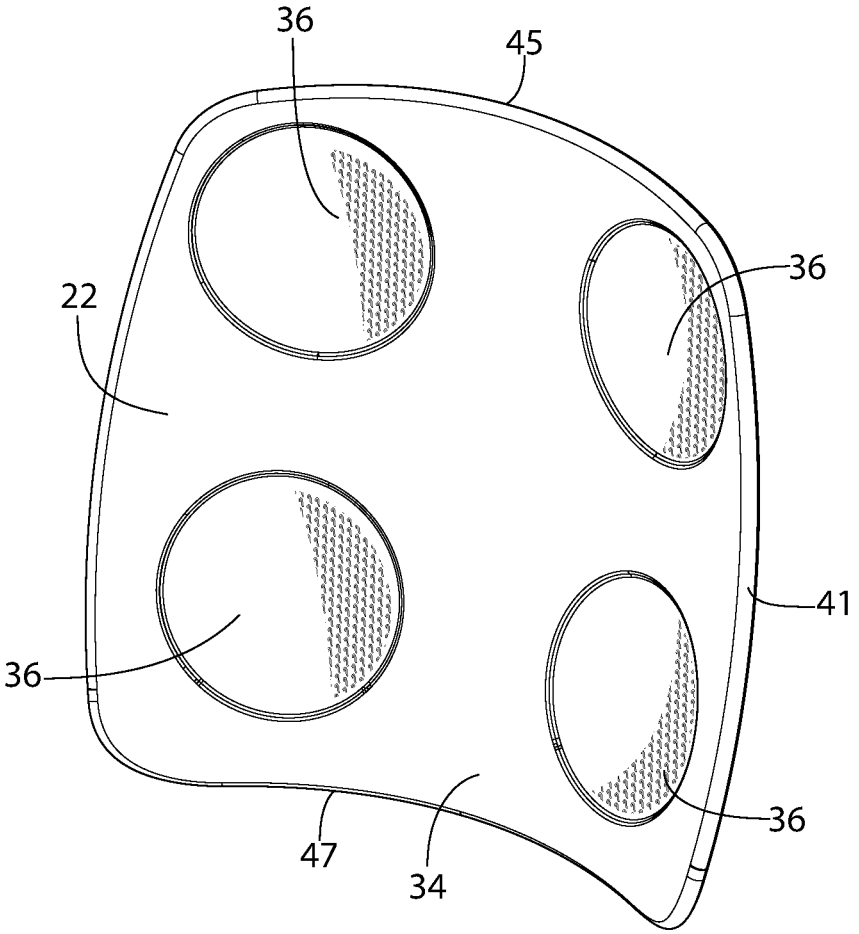
FIG. 11 is a front perspective view of the base of the nape pad of FIG. 1.
Figure 12:
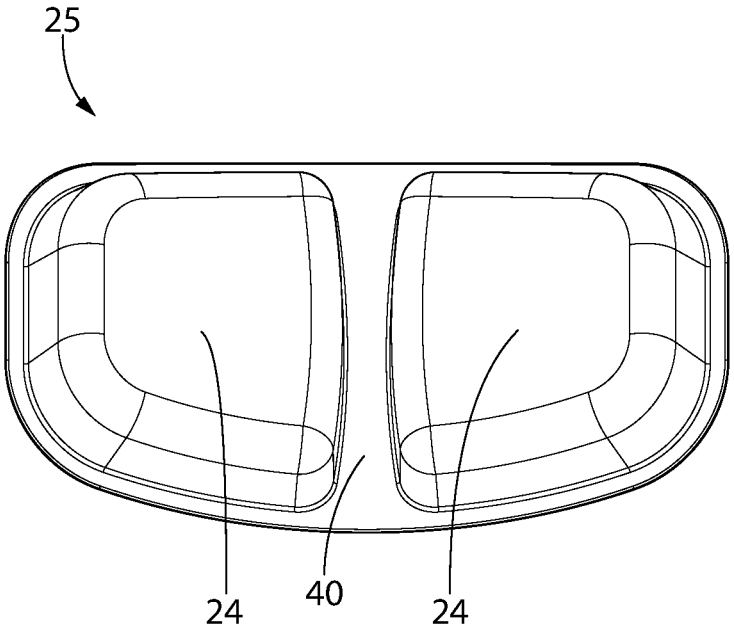
FIG. 12 is a front elevation view of the pad assembly of the nape pad of FIG. 1.
Figure 13:
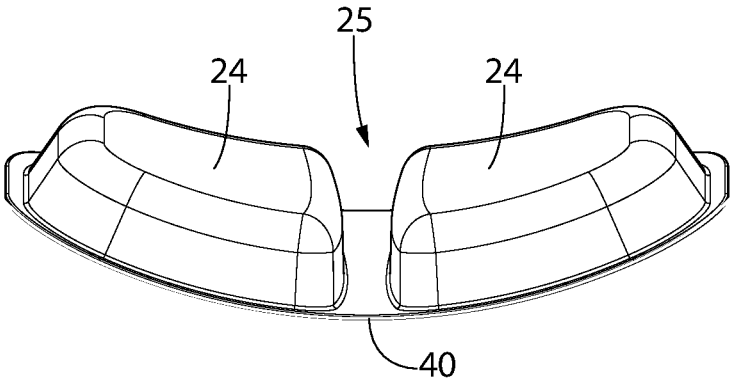
FIG. 13 is a top plan view of the pad assembly of the nape pad of FIG. 1.
Figure 14:
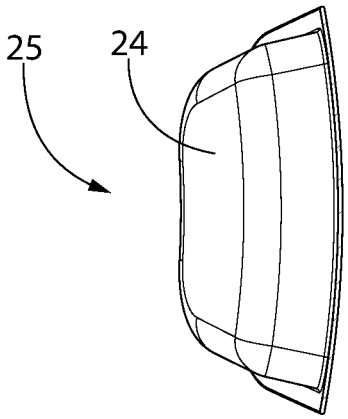
FIG. 14 is a side sectional view of the pad assembly of the nape pad of FIG. 1.

Referring now to FIGS. 13-14, inner surface 34 of base 22 may include at least one second fastener 36 configured to detachably couple compressible pad 24 or a portion of pad assembly 25 (FIG. 11). Inner surface 34 may include a plurality of second fasteners 36 positioned on different locations along inner surface 34. For example, inner surface 34 may include four second fasteners 36 spaced generally equally from one another, each proximate one of four corners 53 and 55 respectively. In one embodiment, each of second fastener 36 may be generally circular in shape. In another embodiment, each of second fastener 36 may be generally ovular in shape. In other embodiments, each of second fastener 36 may have a different regular or irregular geometric shape other than a circular or ovular one. In some embodiments, each of second fasteners 36 may be irregularly spaced from one another. In some embodiments, each of second fasteners 36 have generally the same shape. In other embodiments, at least one of second fasteners 36 may have a different shape than at least one other second fastener 36. In one embodiment, each of second fasteners 36 may have a generally equal depth. In other embodiments, at least one of second fasteners 36 may have a depth, which is different from at least one of second fasteners 36. Each of second fasteners 36 may be generally flexible enough to contour to a curve of the inner surface 34. In one embodiment, at least one of second fasteners 36 is rigid and may have a preconfigured curve to contour to a curve of the inner surface 34. In some embodiments, at least one of second fasteners 36 is a hook and loop fastener. In other embodiments, at least one of second fastener 36 is a magnet, snap fit, or adhesive.

Inner surface 34 may include recessed areas extending into base 22 configured to receive at least one of second fasteners 36. Each of the recessed areas of inner surface 34 may be defined by sidewalls and a bottom surface. The side walls extending from the inner surface 34 to the bottom surface and extending circumferentially around an outer perimeter of the bottom surface. The bottom surface of the recessed areas may be curved to match a contour of the inner surface 34. In some embodiments, the bottom surface of the recessed areas may have a curve that is different from the curve of the inner surface 34. In some embodiments, the bottom surface of the recessed areas may be flat. In one embodiment, the recessed areas of inner surface 34 may be shaped such that there is a generally snug fit for respective second fasteners 36. In other embodiments, the recessed areas of inner surface 34 may be shaped such that there is a gap between the edge of the recessed area and the edge of a respective second fastener 36. In one embodiment, the recessed areas of inner surface 34 may each generally have the same depth. In other embodiments, at least one of the recessed areas of inner surface 34 may have a depth, which is different from at least one of the recessed areas of inner surface 34. In one embodiment, the recessed areas of inner surface 34 may have a decreasing diameter as they extend into base 22. For example, the sidewall extending circumferentially around the bottom surface of the recessed area may be angled relative the bottom surface. In other embodiments, the recessed areas of inner surface 34 may have a generally consistent diameter as they extend into base 22. Each of second fasteners 36 may have a depth equal to or less than the depth of the recessed areas of inner surface 34 such that each of second fasteners 36 does not extend out of the respective recessed areas. Alternatively, each of second fasteners 36 may have a set depth and each of the recessed areas of inner surface 34 may be manufactured to have a depth greater than or equal to the set depth of corresponding second fasteners 36.

Referring now to FIGS. 9-12, pad assemblies 25 may include a plurality of compressible pads 24 coupled to each other. Pad assembly 25 may include any number of compressible pads 24 (e.g., one pad, two pads, three pads, four pads, or five pads). Pad assembly 25 may include fastening means (not shown) configured to couple to corresponding second fasteners 36 of base 22. For example, pad assembly 25 may include loop patches to couple to hook fasteners of second fasteners 36. A plurality of pad assemblies 25 may be coupled to inner surface 34 of base 22. One of pad assemblies 25 may be detachable from base 22 independently from another pad assembly 25. Each compressible pad 24 of a pad assembly 25 may be coupled to membrane 40. Membrane 40 may be flexible and may be detachably coupled to inner surface 34 of base 22 such that pad assembly 25 is detachably coupled to inner surface 34 of base 22. Membrane 40 may be perforated such that air or fluid can enter or exit compressible pad 24. Membrane 40 or compressible pad 24 may have a larger footprint than base 22 such that membrane 40 or compressible pad 24 is visible from a rear of nape pad 20 (FIG. 7). At least a portion of membrane 40 and base 22 may be visible or exposed when nape pad 20 is coupled to retention system 28 (FIGS. 2A-2C).

Compressible pad 24 may be configured to absorb shock from an impact on base 22 (e.g., blunt force impact or impact from a projectile). In some embodiments, compressible pad 24 is fixed to base 22. In other embodiments, compressible pad 24 is detachably coupled to base 22. Compressible pad 24 may include a plurality of pads. At least one of the plurality of compressible pads 24 may be detachably coupled to base 22. Each of the plurality of compressible pads 24 may be independently detachable from base 22. One or more of the plurality of compressible pads 24 may be selectively coupled to base 22 in a plurality of positions.

In some embodiments, the plurality of compressible pads 24 are spaced from each other. In other embodiments, at least one of the plurality of pads is in contact with or adjacent to another of the plurality of pads. One or more of the plurality of compressible pads 24 may be detachably coupled to base 22. The compressible pad 24 may include a pad fastener (not shown) configured to engage second fastener 36 on base 22.

Figure 15:
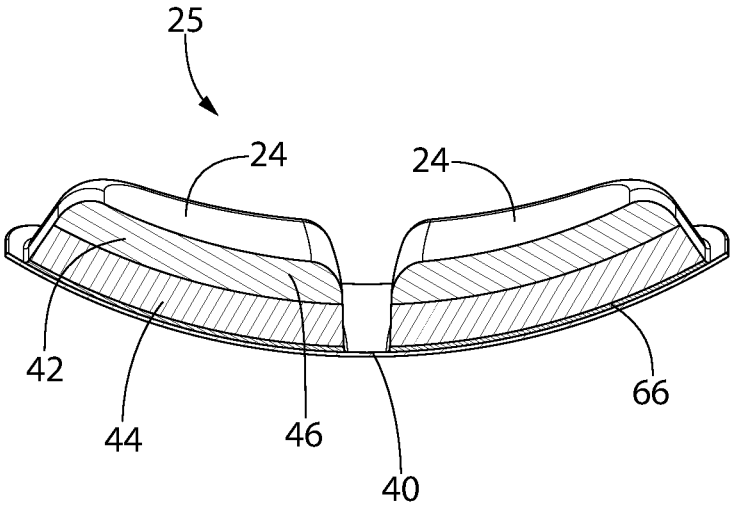
FIG. 15 is a top sectional view of the pad assembly of the nape pad of FIG. 1.

Referring to FIG. 15, compressible pad 24 may include core 42. Core 42 may include one or more layers including, but not limited to, first layer 44 and second layer 46. In some embodiments, core 42 comprises a foam. In some embodiments, core 42 comprises an elastically deformable material. In some embodiments, first layer 44 and second layer 46 are manufactured from different materials. First layer 44 may have a stiffness of about 1-3 pounds per cubic foot (Pcf), about 3-5 Pcf, about 5-7 Pcf, or about 7-10 Pcf. In some embodiments, first layer 44 is stiffer than second layer 46. In other embodiments, second layer 46 is stiffer than first layer 44. Second layer 46 may be adjacent a user's neck and the stiffness of second layer 46 may be selected based on user comfort. The stiffness of first layer 44 may be selected to dissipate or absorb the energy from an impact to nape pad 20 that is passed to the user, first layer 44 may be coupled to second layer 46 via adhesive. Membrane 40 may comprise foam.

Compressible pad 24 may include cover 48 coupled to membrane 40 to define a pocket configured to receive core 42. Cover 48 may be perforated such that gas or fluid can pass through cover 48. Cover 48 and membrane 40 may be manufactured from the same material. Membrane 40 and cover 48 may be a unitary construct. Membrane 40 may also include padding layer 66. Core 42 may not be fixed to membrane 40 or cover 48 such that core 42 can move independently of the membrane 40 and cover 48 within the pocket defined by membrane 40 and cover 48. A waterproof element may line the pocket such that the core 42 is protected from liquid or gas.

Referring now to FIGS. 1-4, as mentioned above, nape pad 20 may be coupled to helmet 26 or retention system 28 of helmet 26. Helmet 26 may include pre-existing fasteners spaced around an inside surface of helmet 26 (e.g. hook and loop fasteners, bolts, snap fit fasteners). Helmet 26 may further include accessory rails 50 positioned on either the left or right side of helmet 26 and a shroud mount 72 attached to a front surface of helmet 26. Shroud mount 72 may be configured to receive optic devices (e.g. night vision goggles, binoculars). Accessory rails 50 may be configured to receive various accessories (e.g. ear protection devices, communication devices, flashlights). In some embodiments, nape pad 20 is detachably coupled to helmet 26 or retention system 28. Base 22 may be configured to detachably couple to a rear portion of helmet 26. In some embodiments, nape pad 20 is configured to be coupled (retrofit) to an existing retention system of helmet 26. In other embodiments, a kit includes nape pad 20 and retention system 28 configured to be coupled to a helmet using existing fastening means of the helmet such as bolts used to attach accessory rails 50 to the helmet or hook and loop patches affixed to the interior or exterior surface of the helmet.

Referring to FIGS. 1, and 16-18, retention system 28 may include at least one front strap 52 configured to extend downwardly from a front of helmet 26. Front strap 52 may a chinstrap. Retention system 28 may include at least one rear strap 54 (FIG. 4) configured to extend downwardly from a rear of helmet 26. Front strap 52 and/or rear strap 54 may be coupled to an inside of helmet 26. Front strap 52 may couple to an inside of helmet 26 in two locations. Front strap 52 may be an adjustable length strap. Front strap 52 may be detachable from helmet 26 Retention system 28 may include at least one cross strap 56 configured to couple to each of at least one front strap 52 and at least one rear strap 54. Cross strap 56 may be transverse to at least one of front strap 52 and rear strap 54. Cross strap 56 may be generally perpendicular to at least one of front strap 52 and rear strap 54. Cross strap 56 may prevent the nape pad 20 from moving off to a side of the user's neck as nape pad 20 moves relative to helmet 26.

Still referring to FIGS. 1, and 16-18, retention system 28 may include fit band 58 at least partially surrounding a user's head when wearing helmet 26. Fit band 58 may have two parts, each of which may extend along a portion of a respective left and right side of the inside of helmet 26. Fit band 58 may extend along generally along a bottom edge of the inside of helmet 26. Fit band 58 may be adjustable to selectively conform fit band 58 to the size of the user's head to help ensure a snug fit of helmet 26 on the user's head. Fit band may extend from a rear portion of helmet 26 along an edge of an inside of helmet 26 to where front straps 52 are connected to helmet 26. Connector 63 may couple both front strap 52 and fit band 58 to helmet 26.

Retention system 28 may include fit band actuator 60 configured to adjust the size of fit band 58. Fit band actuator 60 may be a rotatable knob, worm gear, pull string, or friction buckle. Fit band actuator 60 may allow a user to manually adjust the size and fit of fit band 58 while helmet 26 is on the user's head. Fit band 58 may include a first end fixed to helmet 26 and a second end coupled to fit band actuator 60. Fit band actuator 60 may be adjustable while nape pad 20 is coupled to retention system 28. A user may, by adjusting the size of fit band 58 while nape pad 20 is coupled to retention system 28, tighten or loosen the fit of nape pad 20 relative the user's neck. Nape pad 20 may be decoupled from retention system 28 while fit band actuator 60 is fixed to retention system 28. Fit band actuator 60 may be the rearmost portion of retention system 28. Fit band actuator 60 may selectively reduce or expand the length or diameter of fit band 58.

With continued reference to FIGS. 1-4, at least a portion of fit band actuator 60 may be positioned within fit band adjustment housing 62. Fit band adjustment housing 62 may be a rigid element configured to couple to at least one of rear straps 54 and cross strap 56. In some embodiments, retention system 28 includes two flexible cross straps 56 coupled to fit band adjustment housing 62. Cross straps 56 may be adjustable length straps. Fit band adjustment housing 62 may be positioned between at least a portion of base 22 and helmet 26. Fit band adjustment housing 62 may include one or more openings 68 (FIG. 2A) such that at least a portion of nape pad 20 is visible when the nape pad 20 is coupled to retention system 28. Rear straps 54 may be woven through openings 68 coupling rear straps 54 and fit band adjustment housing 62.

Referring now to FIGS. 1-4, base 22 may be coupled to rear strap 54 and cross strap 56 such that base 22 is positioned between retention system 28 and compressible pad 24 when compressible pad 24 is adjacent a user's neck. In some embodiments, base 22 is directly coupled to at least one of rear straps 54 and cross strap 56. In some embodiments, base 22 is coupled to adjustment housing 62. A portion of base 22 may be within helmet 26 when compressible pad 24 is adjacent a user's neck. A portion of base 22 may extend below the bottom of a rear portion of helmet 26 when compressible pad 24 is adjacent a user's neck. A top (e.g., top edge 45) of base 22 may be spaced from the bottom of the rear portion of helmet 26 when base 22 is coupled to retention system 28. At least a portion of base 22 may be exposed or visible when nape pad 20 is coupled to retention system 28. Base fastener 30 may detachably couple at least one of retention system 28 and compressible pad 24 to base 22. The generally smooth portion 64 may be positioned above the base fastener 30. In some embodiments, base fastener 30 is detachably coupled to corresponding retention fastener 78 (FIG. 18) on retention system 28. In one embodiment, base fastener 30 may include a half of a hook and loop fasteners. In one embodiment, base fastener 30 may be a pad of loops Retention fastener 78 may include a half of a hook and loop fasteners. In one embodiment, retention fastener 78 may be a pad of hooks. In some embodiments, base fastener 30 is fixed to retention system 28. Base fastener 30 may allow base 22 to be coupled to retention system 28 in a plurality of positions or orientations. Base 22 may be positioned between retention system 28 and compressible pad 24 when compressible pad 24 is adjacent a user's neck.

In another embodiment (not shown), second fastener 36 may detachably couple at least one of retention system 28 (e.g., the fit band adjustment housing 62) and compressible pad 24 to base 22. Second fastener 36 may be configured to engage a corresponding fastener on retention system 28 or compressible pad 24. Compressible pad 24 may be coupled to base 22 by a hook and loop fastener. In other embodiments, pads are fixedly attached to base 22 such as through adhesive or spot welding. Base 22 may couple to a rear side of retention system 28 such that retention system 28 is positioned between base 22 and compressible pad 24.

Figure 16A:
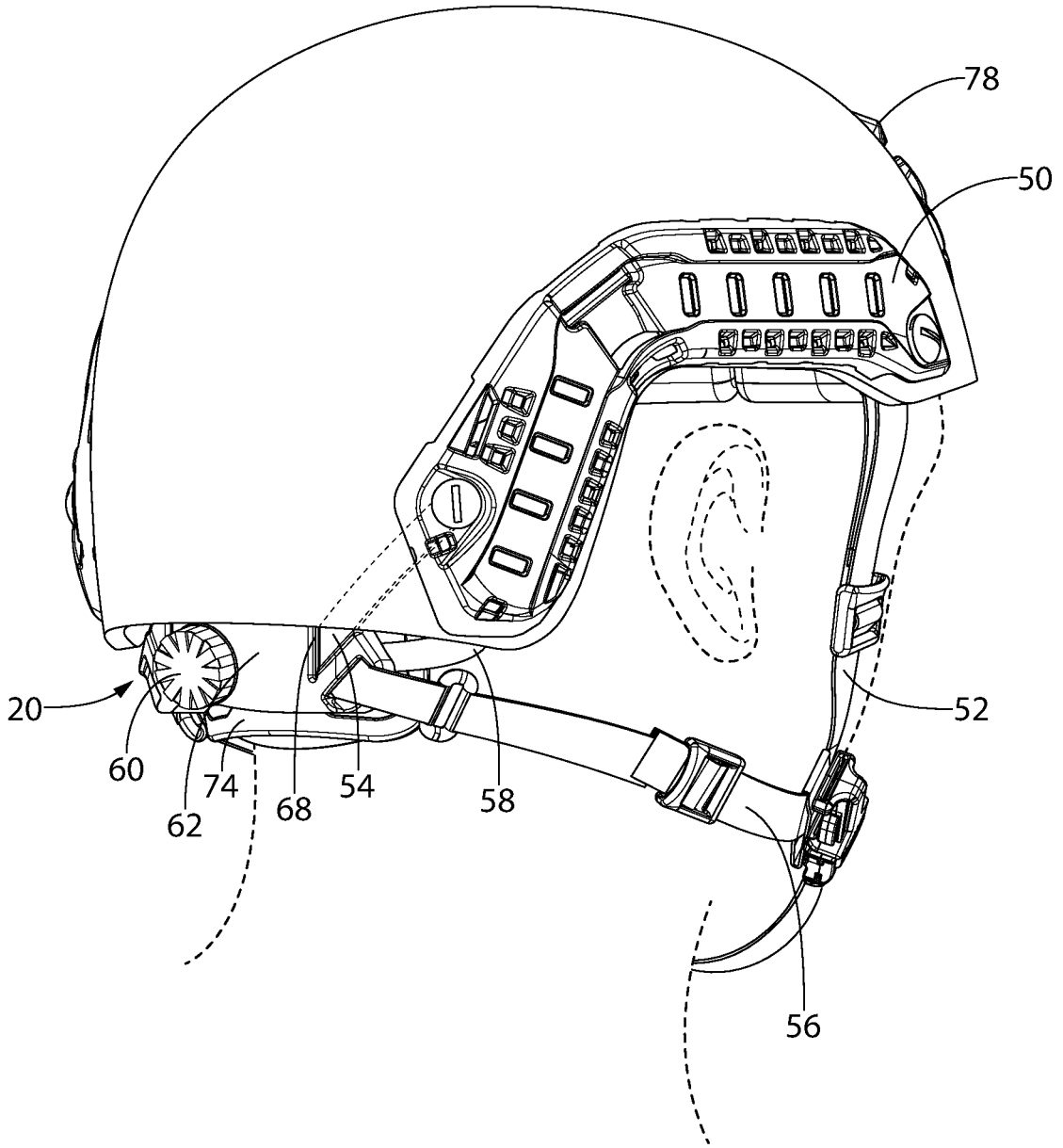
FIG. 16A is a rear perspective view of the helmet system of FIG. 1 corresponding to the position of the helmet when worn by a user looking forward.
Figure 16B:
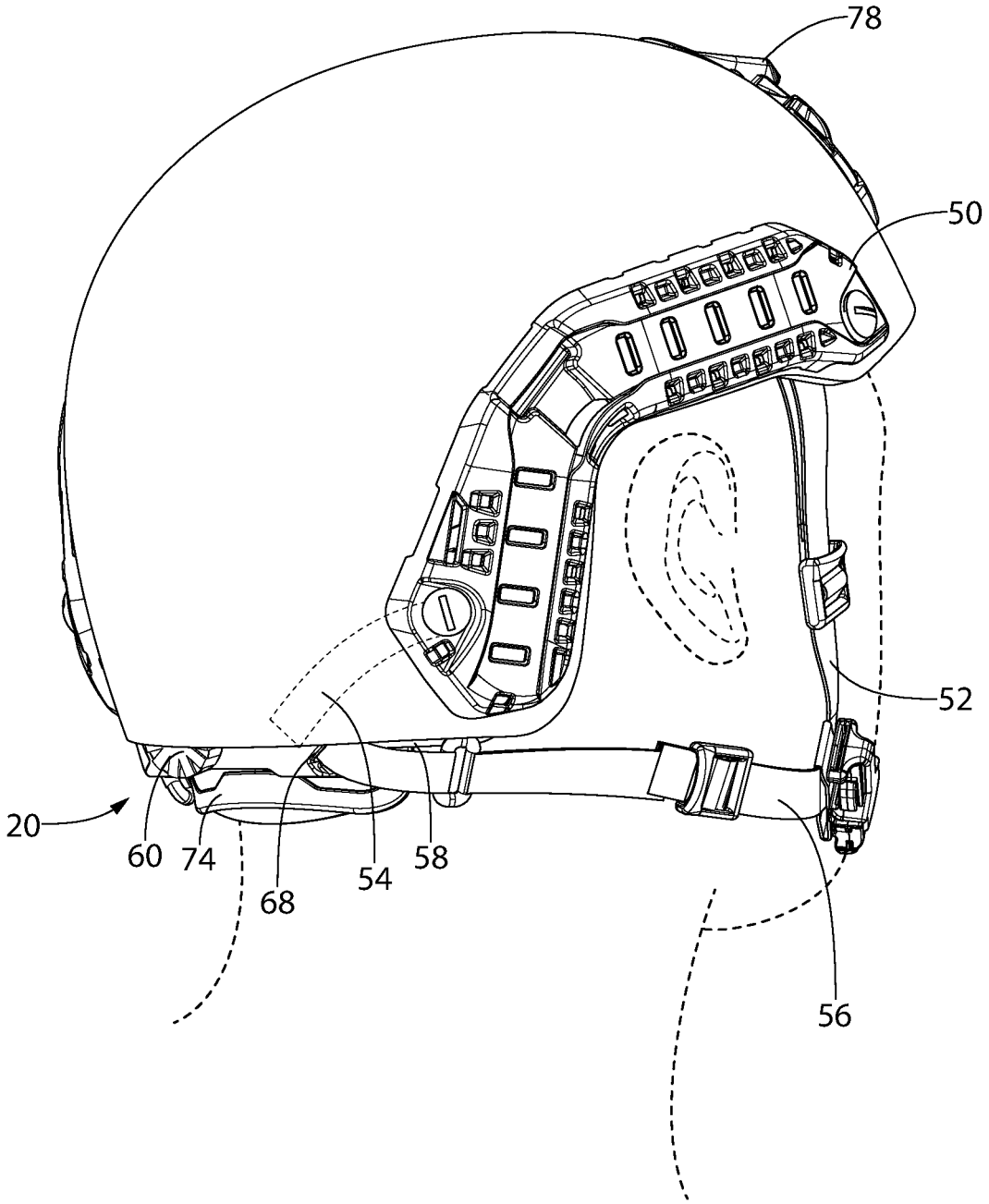
FIG. 16B is a rear perspective view of the helmet system of FIG. 1 corresponding to the position of the helmet system when worn by a user looking up.
Figure 16C:
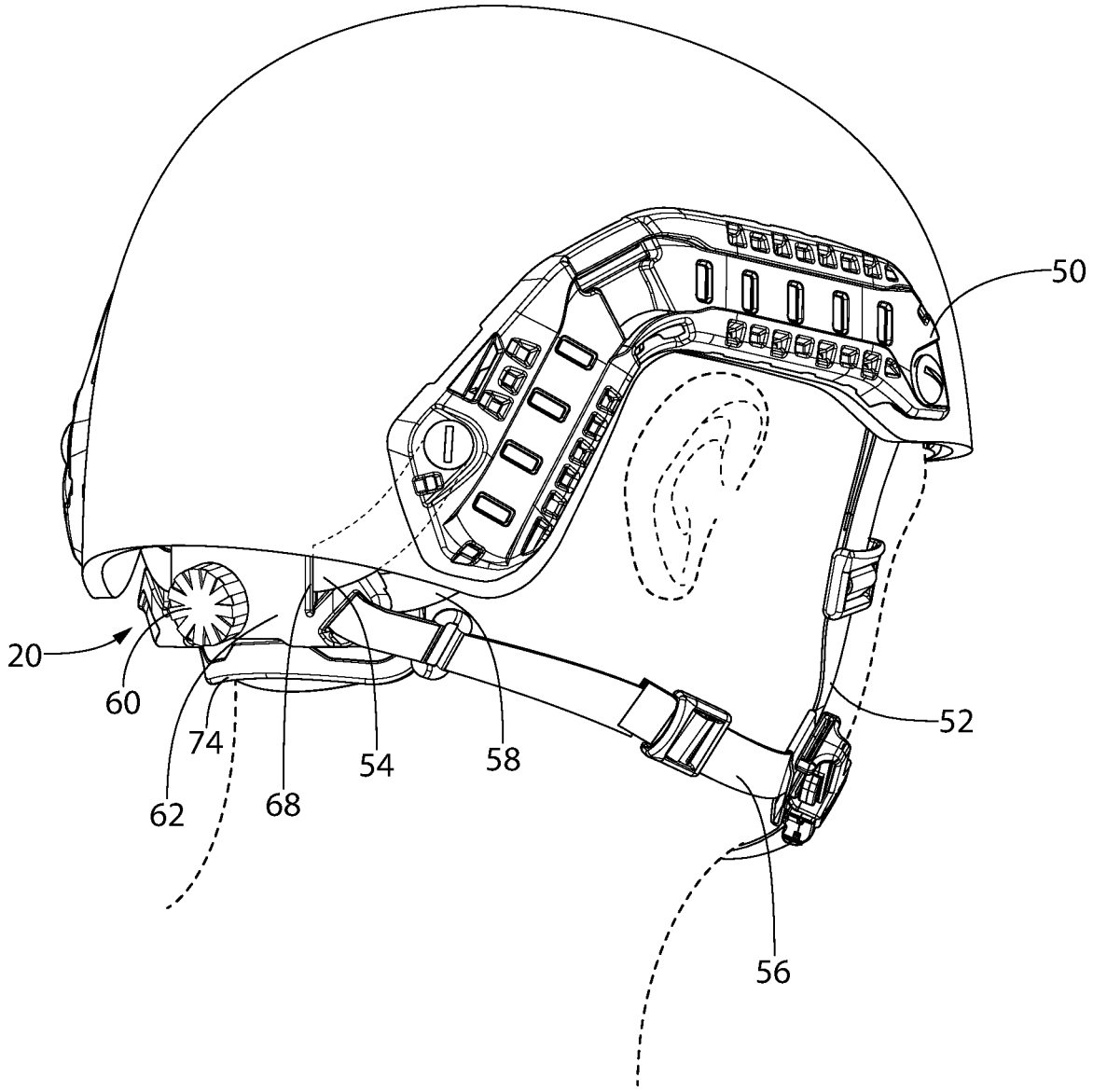
FIG. 16C is a rear perspective view of the helmet system of FIG. 1 corresponding to the position of the helmet system when worn by a user looking down.
Figure 17:
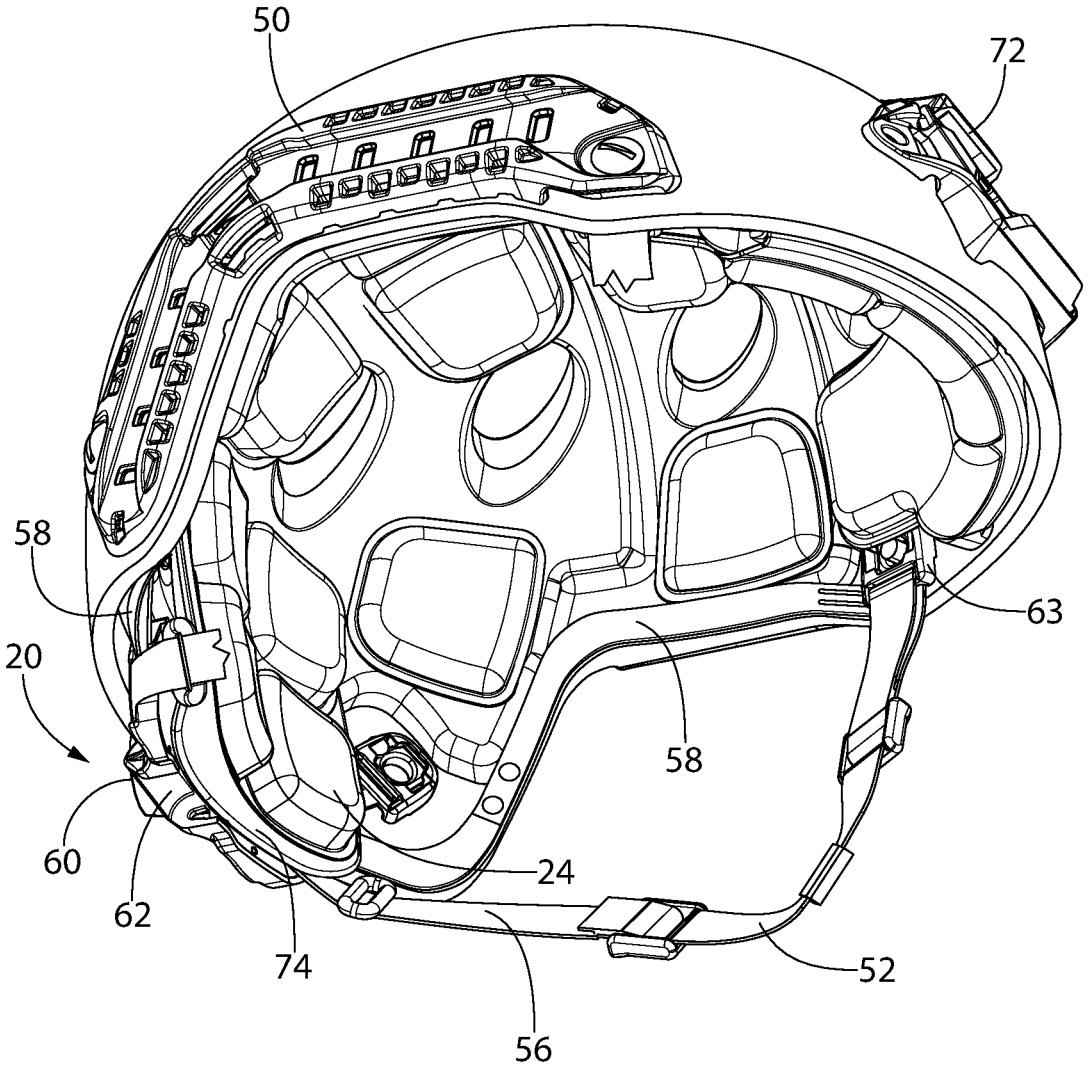
FIG. 17 is a bottom perspective view of the of the helmet system of FIG. 1 including the nape pad and retention system.
Figure 18:
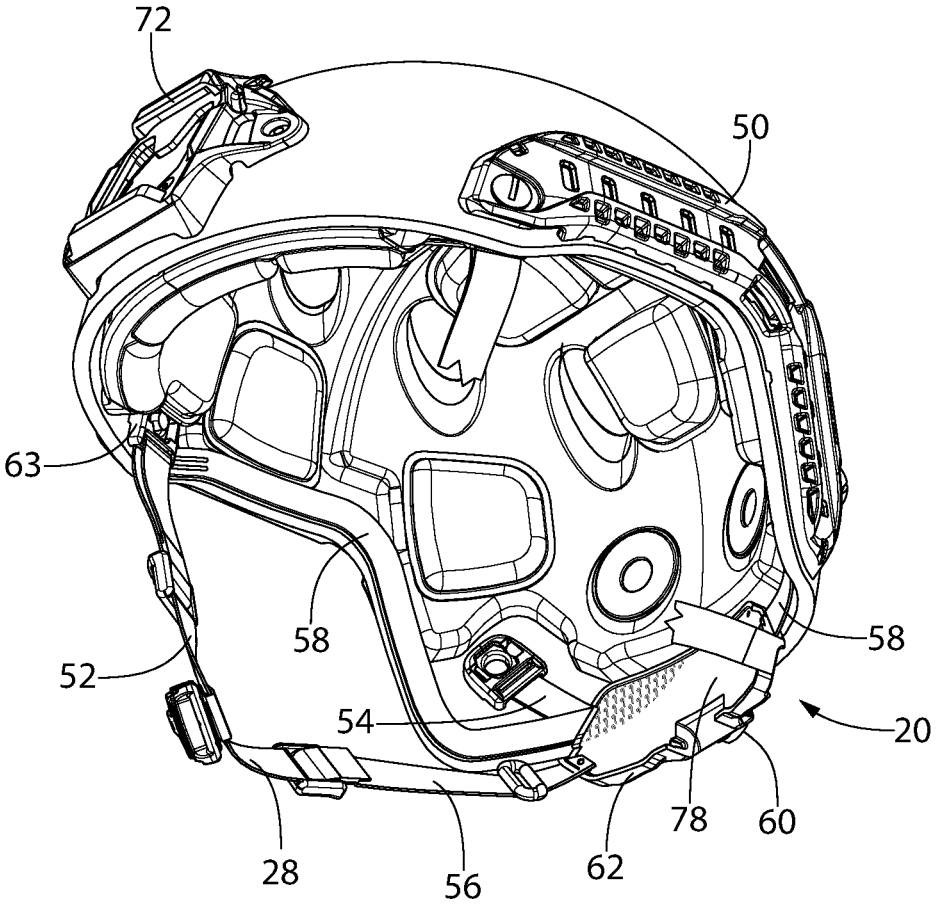
FIG. 18 is a front, bottom perspective view of the helmet of FIG. 1 without the nape pad.

Referring to FIGS. 16A-C, base 22 may be moveable relative to helmet 26 when base 22 is coupled to retention system 28. In some embodiments, compressible pad 24 is generally fixed relative to a user's neck as helmet 26 moves relative to base 22 to form a hinge that at least partially moves with the movement between the nape and the back of the user's head. For example, when the user tilt's their head up (FIG. 2B) to look up, nape pad 20 may stay relatively stationary on the user's nape and the sliding contact between helmet 26 and nape pad 20 allows helmet 26 to slide relative to nape pad 20. In other embodiments, compressible pad 24 slides along a user's neck as base 22 moves relative to helmet 26 such that the position of base 22 relative to helmet 26 is fixed.

The vertical alignment between nape pad 20 and helmet 26 is configured such that at least one of compressible pad 24 and base 22 may be positioned at least partially within helmet 26 when nape pad 20 is coupled to retention system 28. At least a portion of base 22 may be below helmet 26 when a user's head is in a first orientation (e.g., when a user is looking straight ahead) (FIG. 2A). The portion of base 22 or compressible pad 24 within helmet 26 may be greater when user's head is in a second orientation (e.g., when the user is looking up) (FIG. 2B) than in the first orientation. Base 22 may move (e.g., vertically) about 20 mm relative to helmet 26 between first orientation and second orientation. Base 22 may include a position indicator 70 (FIG. 7) that helps a user repeatedly attached base 22 in a preferred position relative to helmet 26. Position indicator 70 may optionally include marking indicia, such as letters or numbers (e.g. A or 1), to mark different positions along the position indicator 70. Positioning a majority of base 22 within helmet 26 may allow greater user mobility (e.g., when looking up or lying prone). Positioning a majority of base 22 outside of helmet 26 may increase user comfort and nape support.

Nape pad 20 and retention system 28 may be sold as a kit. The kit may include more than one nape pad, which may be different sizes. Nape pad 20 may be swapped out for a non-ballistic or different size nape pad. A helmet may be retrofitted to replace the existing retention system with nape pad 20 and retention system 28. A method of retrofitting the existing retention system of a helmet with nape pad 20 may include removing an existing comfort pad or fit band nape pad and attaching nape pad 20 to the retention system. A protection system may include helmet 26, nape pad 20, and retention system 28. The method may additionally include aligning the retention system with one of the markings of position indicator 70 before attaching nape pad 20 to the retention system such that the nape pad is positioned in the desired vertical position relative to the helmet.

It will be appreciated by those skilled in the art that changes could be made to the exemplary embodiments shown and described above without departing from the broad inventive concepts thereof. It is understood, therefore, that this invention is not limited to the exemplary embodiments shown and described, but it is intended to cover modifications within the spirit and scope of the present invention as defined by the claims. For example, specific features of the exemplary embodiments may or may not be part of the claimed invention and various features of the disclosed embodiments may be combined. Unless specifically set forth herein, the terms "a", "an" and "the" are not limited to one element but instead should be read as meaning "at least one".

It is to be understood that at least some of the figures and descriptions of the invention have been simplified to focus on elements that are relevant for a clear understanding of the invention, while eliminating, for purposes of clarity, other elements that those of ordinary skill in the art will appreciate may also comprise a portion of the invention. However, because such elements IO are well known in the art, and because they do not necessarily facilitate a better understanding of the invention, a description of such elements is not provided herein.

Further, to the extent that the methods of the present invention do not rely on the particular order of steps set forth herein, the particular order of the steps should not be construed as imitation on the claims. Any claims directed to the methods of the present invention should not be limited to the performance of their steps in the order written, and one skilled in the art can readily appreciate that the steps may be varied and still remain within the spirit and scope of the present invention.

What is claimed is:

1. A nape pad for use with a helmet, the nape pad comprising:

a base comprised of a rigid material and having an outer surface and an inner surface, a left side and a right side, and a top edge and a bottom edge, the outer surface being generally convex from the left side to the right side and having an upper portion proximate the top edge and a lower portion proximate the bottom edge, the upper portion of the outer surface being generally smooth and configured to abut and slide along an inner surface of the helmet, the inner surface of the base being generally concave from the left side to the right side and configured to face away from the inner surface of the helmet;

a fastener coupled to the lower portion of the outer surface of the base and configured to releasably couple to a retention system of the helmet; and at least one compressible comfort pad coupled to the inner surface of the base and extending outwardly therefrom.

2. The nape pad of claim 1, wherein the top edge is defined in one plane by a radius of an arcuate portion of a circle, the arcuate portion configured to generally contour to the nape of a user's neck.

3. The nape pad of claim 1, wherein the bottom edge has generally the same radius as the top edge.

4. The nape pad of claim 1, wherein the base has a width defined by the lateral distance between the left and right sides and a height defined by a longitudinal distance between the top and bottom edge, the height being generally equal to the width.

5. The nape pad of claim 1, wherein the base has a width defined by the lateral distance between the left and right sides and a height defined by a longitudinal distance between top and bottom edge, the height being greater than or equal to the width.

6. The nape pad of claim 1, wherein the base is comprised of one or more of a ceramic material, an aromatic fiber, a metal, a polycarbonate, or a reinforced polymer.

7. The nape pad of claim 1, wherein the bottom edge includes a flared portion extending along the bottom edge, the flared portion being curved away from the inner surface of the base.

8. The nape pad of claim 7, wherein the flared portion on the outer surface of the base is concave from the bottom edge of the base to the where the convex curve of the outer surface ends in the longitudinal direction.

9. The nape pad of claim 7, wherein the fastener extends from the flared portion to the upper portion of the outer surface of the base.

10. The nape pad of claim 1, wherein the fastener includes indicia markings corresponding to a plurality of attachment positions along the fastener.

11. The nape pad of claim 1, wherein the fastener is a first fastener and the base includes a second fastener coupled to the inner surface, wherein the at least one compressible comfort pad is releasably coupled to the second fastener.

12. The nape pad of claim 1, wherein the fastener includes a plurality of hooks to form half of a hook and loop fastener.

13. A retention system for a helmet, the retention system comprising:

the nape pad of claim 1, wherein the retention system is configured to be coupled to the helmet and at least one fastener of the nape pad, and wherein the upper portion of the nape pad is configured to be slidably coupled to the inner surface of the helmet.

14. A helmet system comprising:

a helmet having a front portion, a rear portion, and a bottom periphery;

a retention system comprised of, at least one front strap coupled to an inside surface of the helmet and extending downwardly from the front portion of the helmet, at least one rear strap coupled to the inside surface of the helmet and extending downwardly from the rear portion of the helmet, and at least one cross strap coupling the at least one rear strap and at least one front strap, the at least one cross strap being generally transverse to one or more of the at least one front strap and the at least one rear strap;

a base comprised of a rigid material and having an outer surface, an inner surface, a left side, a right side, a top edge, and a bottom edge, the outer surface being generally convex from the left side to the right side and having an upper portion proximate the top edge and a lower portion proximate the bottom edge, the upper portion of the outer surface slidably coupled to and abutting the inside surface of the helmet, the inner surface of the base being generally concave from the left side to the right side and facing away from the inside surface of the helmet;

a first fastener coupled to the lower portion of the outer surface of the base and releasably coupled to the retention system, the first fastener including a plurality of loops to form half of a hook and loop fastener;

at least one compressible comfort pad coupled to the inner surface of the base and extending outwardly therefrom; and a second fastener coupled to the base opposite the first fastener, the second fastener including a plurality of hooks to form half of a hook and loop fastener, wherein the at least one compressible comfort pad is coupled to the second fastener.

15. The helmet system of claim 14, wherein the base has a width defined by the lateral distance between the left and right sides and a height defined by a longitudinal distance between the top and bottom edge, the height being greater than or equal to the width.

16. The helmet system of claim 14, wherein the bottom edge includes a flared portion extending along the bottom edge, the flared portion being curved away from the inner surface of the base.

* * * * *